US005092091A

United States Patent [19]

Hull et al.

[11] Patent Number: 5,092,091

[45] Date of Patent: Mar. 3, 1992

[54] CONCRETE CONTROL KEY-JOINT AND DIVIDER FORM

[76] Inventors: Harold L. Hull, 401 Canyon Way #43, Sparks, Nev. 89434; Kenneth A. Berry, 10775 Osage Rd., Reno, Nev. 89506; Stephen C. Benna, 535 Marsh Ave., Reno, Nev. 89502

[21] Appl. No.: 520,277

[22] Filed: May 7, 1990

[51] Int. Cl.[5] ..... E01C 13/00

[52] U.S. Cl. ..... 52/396; 404/48; 404/68

[58] Field of Search ..... 404/47, 48, 49, 68; 52/396, 403

[56] References Cited

U.S. PATENT DOCUMENTS

| | | | |
|---|---|---|---|
| 924,993 | 6/1909 | Johnson | 404/47 X |
| 1,697,563 | 1/1929 | Heltzel | 404/49 |
| 1,769,990 | 7/1930 | Fischer | 404/68 |
| 1,880,725 | 10/1932 | Bleck | 404/48 |
| 4,659,247 | 4/1987 | Steiner | 404/68 |

*Primary Examiner*—Richard E. Chilcot, Jr.

[57] ABSTRACT

A concrete control key-joint and divider form made from plastic which is substantially wedge-shaped with vertically spaced holes to receive plastic stakes with the stakes being secured to the plastic form by plastic bolts at substantially its mid-section, so that the form can be easily set to grade and locked to the stakes, then the plastic stakes and bolts can be cut off to form a smooth screeding surface and an expansion joint. The forms also provide transversely spaced holes through which smooth rods or rebar may be inserted to firmly hold the form in a vertical manner and yet allow the concrete slabs to expand and contract. The plastic material is also designed to expand and contract at substantially the same expansion coefficient as cured concrete, thus minimizing the working of the key-joint.

9 Claims, 2 Drawing Sheets

CONCRETE CONTROL KEY-JOINT AND DIVIDER FORM

This invention relates to concrete key-joints and divider forms used between adjacent slabs of poured concrete and more particularly to a key-joint which acts as a form which is set to grade by stakes which can be locked in place and cut off at the screed level while at the same time providing a working joint for smooth rebar.

BACKGROUND OF THE INVENTION

Key-joint forming divider strips of the general type to which the present invention relates are used worldwide in the formation of concrete slabs for use in concrete airfield runways, roadways, building floors and the like and in general are in the form of elongated sheet metal pieces, the lower regions of which are formed with coextensive laterally offset portions in order to establish the desired key-joint in the adjacent poured concrete slabs and the upper regions of which folded over or bent portions in order to form upstanding screeds which have horizonally linearly straight upper edges and are adapted to support screed boards in connection with concrete levelling operations. In between such lower and upper regions of the strips, there are usually provided recesses, sockets or downward facing channels for reception of the upper ends of the stakes which are used in connection with the strips. The nature of such stake-receiving recesses, sockets or channels varies widely in connection with both the stake-receiving and screed-forming facilities of previously designed and used key-joint forming divider strips.

In the past, many such key-joints have been proposed and have been generally accepted in the trade, however, each of them have inherent problems which the present invention addresses.

One of the problems experienced with these products has been the possibility of the form not gripping the stake regidly enough to prevent the form from slipping and floating off before or during the pouring of the concrete.

Also, installing these forms are labor intensive and many require special tools for crimping the lower edge of a downturned flange into the aperture for locking the form onto the stake such as U.S. Pat. No. 3,288,042 or the device of U.S. Pat. No. 3,401,612 which requires a notch in each of the opposite sides of the stake so that a tool must be used to deform the lower edge of the downturned flange until it interlocks with the notch and makes a mechanical connection between the form and the stake.

Many of the prior art patents such as U.S. Pat. No. 3,784,313 depend on the height of the stake for vertical adjustability which requires ideal working conditions, close tolerances and provides a weak locking action between the form and its supporting stakes.

In other cases such as U.S. Pat. No. 1,345,179 the concrete form is hung from a bracket member on each stake, leaving the stake protruding above the top edge of the concrete forms so that a screed cannot be used as in the present invention, to move across the top edge of the key-joint that serves as a leveling guide to smooth out the concrete surface.

U.S. Pat. No. 4,455,104 attempts to address these problems by providing a stake and form arrangement which interlocks, however only a limited amount of vertical adjustability is possible, thus this device again depends on the height of the stake.

SUMMARY OF THE INVENTION

The present invention provides a versatile stake and form arrangement that can be used in any situation and does not depend on the height of the stake for grade level, while at the same time providing for a working key-joint, an unobstructed screed surface, means connecting adjacent slabs of concrete with smooth rebar and a top edge to control breakage at the expansion joint.

It is therefore a primary object to provide a plastic substantially wedge-shaped form which may be provided in a variety of depths and widths for different applications.

Another object is to provide a form and stake arrangement that is totally adjustable in height to establish grade level.

Still another object is to provide a plastic stake which may be sawed off at the screed level to provide a smooth surface for the screeding process.

Another object is to provide a plastic bolt which may be sawed off to allow the adjacent slabs to expand and contract.

Yet another object is to provide a form which will accept smooth rebar to connect adjacent concrete slabs.

Another important object is to provide a ledge on each side of the form which reduces breakage of the concrete at the key-joint.

Yet another object is to provide a ledge on each side of the form which cooperates with the concrete slabs to provide a firm level surface which heavy equipment can cross such as aircraft and which still allows the concrete slabs to expand and contract.

Still another object is to provide a locking arrangement between the form and a stake which is extremely solid which requires no special tools, but may be locked in place by a standard cresent wrench or the like.

Another important object is to make the substantially wedge-shaped member, stakes and bolts from a suitable plastic which will expand and contract at substantially the same rate as cured concrete, thus minimizing the expansion and contraction of the key-joint.

Another object is to provide a form and stake device that is expendable and time and labor saving.

Other objects and advantages will become apparent when taken in consideration with the following drawings and specifications.

DETAILED DESCRIPTION OF THE DRAWINGS

Figure 1:
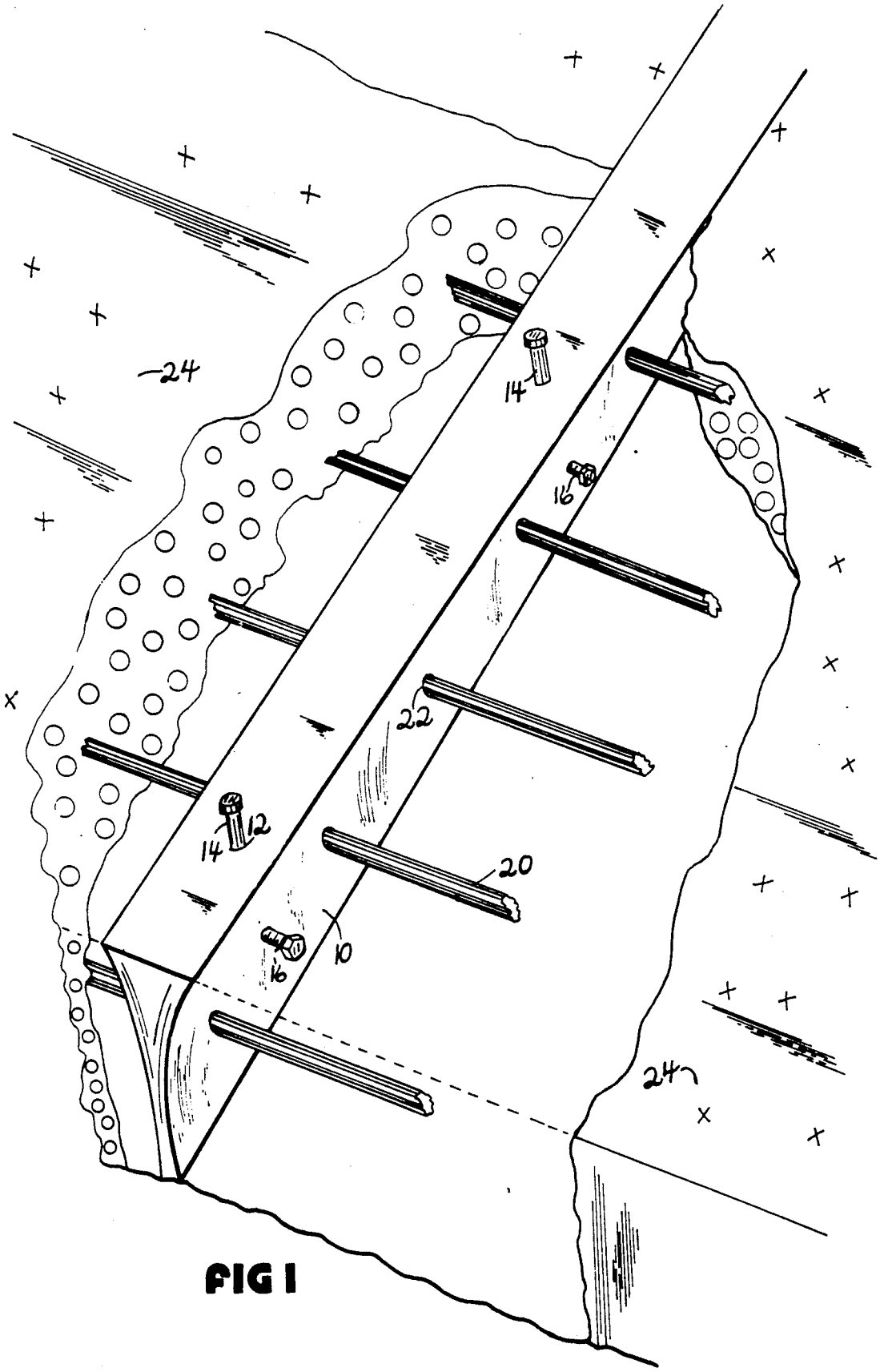
FIG. 1 is a perspective cut-a-way view of the forms, stakes, rebar rods and concrete slabs in place.
Figure 2:
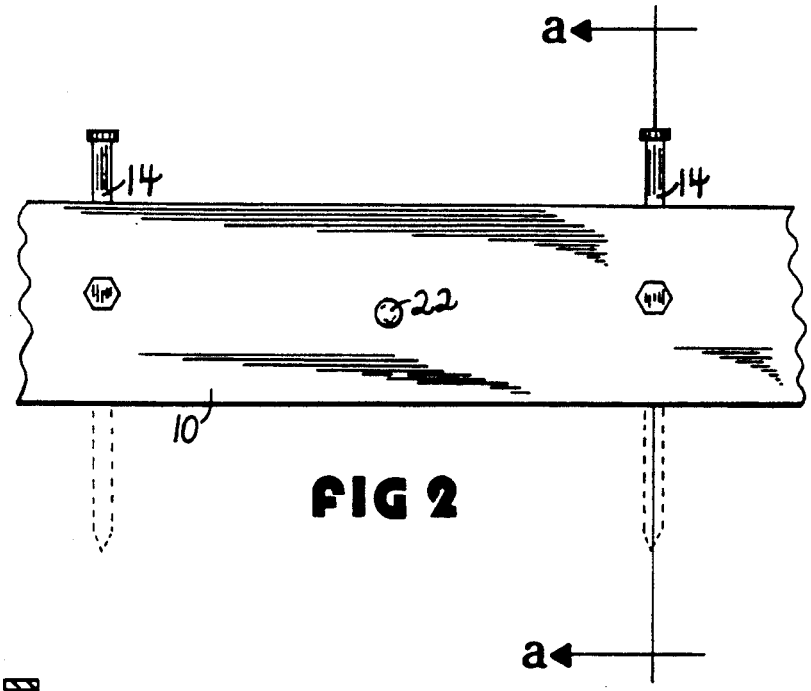
FIG. 2 is a side view.
Figure 3:
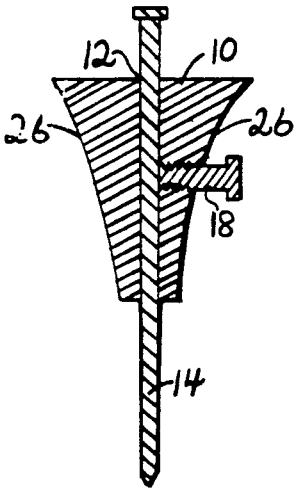
FIG. 3 is a section taken at a*—a* of FIG. 2.
Figure 4:
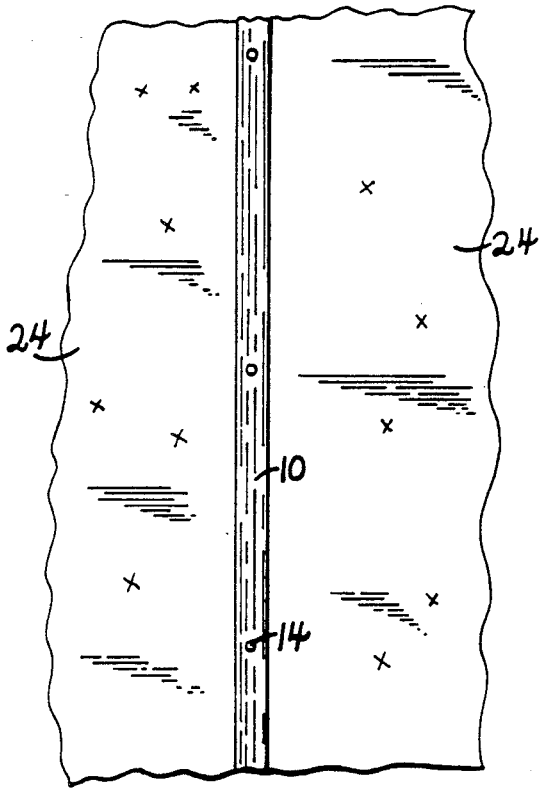
FIG. 4 is top view of the finished key-joint and concrete slabs.

Referring now to the drawings wherein like numerals indicate like parts throughout the various views, 10 is an elongated, substantially wedge-shaped, plastic member with vertical holes 12 cooperating with plastic stakes 14 with bolts 16 locking stakes 14 to the substantially wedge-shaped plastic member 10 by threads 18, while 20 is rebar penetrating through holes 22 which are buried in the slabs 24, while 20 are concave arches which cooperate with the poured concrete slabs 24 to provide a working key-joint.

It will now be seen that the substantially wedge-shaped plastic members, which can be made from any suitable plastic in any suitable lengths, widths and height by prior art manufacturing methods such as injection molding, pressure roller molding, extrusion, etc., may be staked to the ground by the plastic stakes and locked into place by the plastic bolts when the substantially wedge-shaped plastic members are leveled to grade level. Then the smooth rebar pieces are placed horizontally through the holes in the substantially wedge-shaped plastic members which further supports and firms the substantially wedge-shape plastic members and holds them firmly at grade level, after which the plastic stakes and bolts may be cut off at the screed line and wedge line respectively, thus providing a smooth screed surface and a clean working key-joint. The plastic substantially wedge-shaped member, stakes and bolts are expendable and can be designed and engineered to expand and contract at substantially the same expansion and contraction rate as the poured concrete, thus providing a minimum of key-joint movement.

We have now provided a simple plastic, substantially wedge-shaped form, which can be staked to the ground and raised or lowered to grade level and locked into place by plastic bolts.

We have also taught that the plastic substantially wedge-shaped members may be manufactured in any suitable lengths, widths and heights by conventional methods for application in different construction situations such as airport runways, roadways, building slabs, etc.

We also have provided a form that expands and contacts at substantially the same rate as cured concrete, thus eliminating most of the movement between the slabs and the key-joint.

We have further demonstrated that the stakes and bolts may be cut off at the screed line and the sides of the form line to allow screeding and expansion, respectively.

We have further shown how smooth rebar may be inserted through the substantially wedge-shaped form member to allow any expansion or contraction which might occur, as the cured concrete can slip on the smooth rebar to prevent cracking.

Also we have shown how the substantially wedge-shaped form member is held securely in place in vertical and horizontal planes by the stakes, bolts and rebar.

Also it will be seen that no special tools are needed to install the form but a simple crescent wrench tightens and loosens the fastening bolts to easily set the form at grade level.

We also have shown how this simple key-joint is labor saving and can be installed without special skills.

Although the invention has been shown and described in what is conceived to be the most practical and preferred embodiment, it is recognized that departures may be made therefrom within the scope of the invention, which is not to be limited to the details disclosed herein but it is to be accorded the full scope of the claims so as to embrace any and all equivalent devices and apparatus.

Having described our invention, what we claim as new and desire to secure by Letters Patent is:

1. A plastic concrete joint form and supporting stakes comprising; a plastic elongated member, said member being in its transverse, cross section, substantially wedge-shaped, said member having a first set of spaced holes in its vertical plane, said first set of spaced holes cooperating with plastic stakes, said plastic stakes being of a sufficient size and length to penetrate said plastic member through said first set of spaced holes and enter a supporting surface, said substantially wedge-shaped member having a second set of spaced holes in its transverse horizontal plane, said second set of spaced holes cooperating with said first set of spaced holes to allow plastic bolts to be threadably engaged in said substantially wedge-shaped member to engage said plastic stakes, securely holding said plastic member and said plastic stakes in a fixed relationship, said plastic member having a third set of spaced holes, said third set of spaced holes being located substantially at the mid-section of said substantially wedge-shaped member in its transverse, horizontal plane, said third set of spaced holes cooperating with sections of rebar to allow said rebar to be inserted transversely through said third set of spaced holes and protrude on both sides of said plastic substantially wedge-shaped member.

2. The device of claim 1 in which said plastic, elongated, substantially wedge-shaped member has concave arches along both of its parallel sides.

3. The device of claim 2 in which said concave arches form substantially a ledge along said parallel sides of said plastic, elongated, substantially wedge-shaped member.

4. The device of claim 1 in which said plastic member is made of a plastic with substantially the same expansion and contraction coefficient of cured concrete.

5. The device of claim 1 in which said stakes and said bolts are made of a plastic with substantially the same expansion and contraction coefficient of cured concrete.

6. The device of claim 1 in which said rebar are smooth rods to allow cured concrete to slip on said rods, providing an expansion key-joint.

7. The device of claim 1 in which said third set of spaced holes are substantially the same size as said rebar to allow said rebar to act as a vertical support for said plastic member.

8. The device of claim 6 in which said smooth rods are substantially the same size as said third set of said holes to allow said smooth rods to act as a vertical support for said plastic member.

9. The device of claim 1 in which said plastic stakes and said plastic bolts are made of a plastic suitable for cutting with conventional tools.

* * * * *